US005511900A

United States Patent [19]

Macku

[11] Patent Number: 5,511,900

[45] Date of Patent: Apr. 30, 1996

[54] REVERSIBLE HANDEDNESS SCREED CONTROL DEVICE

[75] Inventor: Charles G. Macku, Cedar Rapids, Iowa

[73] Assignee: Cedarapids, Inc., Cedar Rapids, Iowa

[21] Appl. No.: 356,701

[22] Filed: Dec. 15, 1994

[51] Int. Cl.[6] ..... E01C 19/00

[52] U.S. Cl. ..... 404/84.1; 404/101; 404/118; 74/424.8 R

[58] Field of Search ..... 404/72, 84.1, 96, 404/114, 118–120; 74/89.15, 424.8 R, 424.8 B

[56] References Cited

U.S. PATENT DOCUMENTS

| | | | |
|---|---|---|---|
| 1,166,673 | 1/1916 | Goodfellow . | |
| 2,788,424 | 4/1957 | Huelskamp et al. . | |
| 3,182,524 | 5/1965 | Knox . | |
| 3,184,214 | 5/1965 | King . | |
| 3,779,094 | 12/1973 | LaBarre | 74/424.8 R |
| 3,803,926 | 4/1974 | Winter | 74/89.15 |
| 3,844,177 | 10/1974 | Bourassa | 74/89.15 |
| 4,343,200 | 8/1982 | Alworth et al. | 74/57 |
| 4,657,304 | 4/1987 | Heesch et al. | 297/391 |
| 5,311,788 | 5/1994 | Kasuga | 74/89.15 |
| 5,356,238 | 10/1994 | Musil et al. | 404/84.1 |

FOREIGN PATENT DOCUMENTS 1255527 9/1986 U.S.S.R. .

*Primary Examiner*—Ramon S. Britts
*Assistant Examiner*—Pamela A. O'Connor
*Attorney, Agent, or Firm*—Simmons, Perrine, Albright & Ellwood

[57] ABSTRACT

An improved screed control device includes two pairs of interacting cylindrical surfaces for controlling the "angle of attack" or elevation of a screed of a paver, a first pair of the two pairs of interacting surfaces having either right-hand or left-hand threads and the other pair of interacting surfaces having threads with handedness opposite from that of the first pair. A reversing pin is adapted to selectively maintain one pair of the two pairs of interacting surfaces stationary relative to each other as a hand-crank arrangement operationally causes the other pair to threadably interact. Handedness of the control device is accomplished by moving the reversing pin to a different set of co-linearly aligned apertures such that the threadably interacting pair of the two pairs of interacting surfaces are caused to become stationary relative to each other and the stationary pair to become threadably interacting relative to each other. The apertures may be slots with major axes parallel to an longitudinal axis of the device to simplify insertion of the reversing pin. First and second embodiments provide additional arrangements for the two pairs of interacting surfaces.

7 Claims, 1 Drawing Sheet

REVERSIBLE HANDEDNESS SCREED CONTROL DEVICE

BACKGROUND OF THE INVENTION

Many types of equipment require manual adjustments for varying certain parameters thereof. One particular application wherein such adjustments are a common occurrence is adjustment of the "angle of attack" or elevation of a screed of an asphalt paving machine as required to produce the desired depth or thickness of the paving material being laid by the paver. Such thickness control of an asphalt paver traditionally consists of manipulation of a hand-crank. Turning the hand-crank rotates a threaded shaft which causes the change in the "angle of attack" of the screed and thus changes the depth or thickness of the paving material being placed by the paver.

More specifically, turning the hand-crank clockwise causes the elevation of the screed to be raised or lowered, as the case may be, whereas turning the hand-crank counter-clockwise causes a change in elevation of the screed opposite to that obtained with the clockwise rotation.

Operators of asphalt pavers generally have a strong preference as to which direction of hand-crank rotation raises the screed. Some operators prefer clockwise rotation of the hand-crank for increasing the thickness of the paving material, while others prefer counter-clockwise rotation for the same effect.

For that reason, the threaded shaft rotated by the hand-crank is generally provided with two different configurations: a left-hand (LH) version having "left-hand" threads and a right-hand (RH) version having "right-hand" threads. Thus, the desired rotational action is obtained by utilizing equipment with a hand-crank and screw arrangement having the desired handedness.

Unfortunately, an operator's preferred handedness may not be known until the paving machine is put into service. Under those circumstances, if the handedness is incorrect for the operator, the obvious alternative is to change the handedness of the control screw in the field, generally at considerable expense and inconvenience. Further, if two operators use the same paver, each operator having a different handedness preference, such as one operator being left-handed and the other being right-handed, then one of the operators is satisfied with the handedness provided for controlling the elevation of the screed whereas the other operator is not.

What is needed is a thickness control mechanism that interchangeably provides either left-handed rotation action or right-handed rotation action for elevating the screed and, further, which can be quickly and easily field converted from one type of handedness to the other.

SUMMARY OF THE INVENTION

A device for controlling the "angle of attack" or elevation of a screed of an asphalt paver wherein the handedness thereof is field reversible. The device includes elevating means, cranking means and reversing means. The elevating means has two pairs of threadably interacting cylindrical surfaces, a first pair of the interacting surfaces between a sleeve having a tapped axial bore and a threaded sleeve end of an elevator and the other pair of the interacting surfaces, having threads with handedness opposite to those of the first pair of the interacting surfaces, between a tapped axial bore of a linkage pivotally connected to the screed and a linkage end of the elevator. The sleeve has a pair of co-linearly aligned, transversely opposing sleeve apertures and the sleeve end of the elevator has an aperture adapted to be co-linearly alignable with the pair of sleeve apertures. Similarly, the linkage has a pair of co-linearly aligned, transversely opposing sleeve apertures and the linkage end of the elevator has an aperture adapted to be co-linearly alignable with the pair of linkage apertures.

The device also includes cranking means adapted to manually and rotationally operate the elevating means. The cranking means includes a hand-crank having a shaft rotationally mounted to the paver about an axis. The shaft has a distal end fixedly attached to the sleeve.

The device also includes reversing means adapted to change the cranking means either from a right-handed rotational operation to a left-handed rotational operation or from a left-handed rotational operation to a right-handed rotational operation. The reversing means includes provisions for selectively maintaining one pair of the interacting surfaces stationary relative to each other as the other pair of the interacting surfaces are allowed to move relative to each other. The respective pair of interacting surfaces are maintained stationary by a reversing pin slidably inserted either through the pair of sleeve apertures substantially co-linearly aligned with the first elevator aperture or through the pair of linkage apertures substantially co-linearly aligned with the second elevator aperture, as appropriate.

A first modified embodiment of the device includes a first pair of threadably interacting cylindrical surfaces between a sleeve and the shaft of a hand-crank having either right-handed or left-handed threads and a second pair of threadably interacting cylindrical surfaces between a linkage pivotally connected to the screed and a linkage end of the elevator having threads with handedness opposite to that of the first pair of interacting surfaces. The sleeve has a pair of co-linearly aligned, transversely opposing sleeve apertures and the shaft has an aperture adapted to be co-linearly alignable therewith and to receive a reversing pin therethrough. Similarly, the linkage has a pair of co-linearly aligned, transversely opposing sleeve apertures and the linkage end of the elevator has an aperture adapted to be co-linearly alignable with the pair of linkage apertures.

A second modified embodiment of the device includes an elevator sleeve having a longitudinal throughbore wherein the elevator sleeve has a threaded outer peripheral surface and a tapped inner surface with threads having a handedness opposite to those of the outer peripheral surface. A hand-crank has a threaded shaft adapted to threadably interact with the tapped throughbore of the elevator sleeve and a linkage pivotally connected to the screed has a tapped partial bore adapted to threadably interact with the threaded outer peripheral surface of the elevator sleeve. The elevator sleeve has a first pair of co-linearly aligned, transversely opposing apertures adapted to be co-linearly alignable with a throughbore of the shaft as a reversing pin is slidably receivable therethrough. Similarly, the linkage has a pair of co-linearly aligned, transversely opposing linkage apertures adapted to be co-linearly alignable with a second pair of co-linearly aligned, transversely opposing elevator sleeve apertures as the reversing pin is slidably receivable therethrough.

OBJECTS AND ADVANTAGES OF THE INVENTION

Therefore, the principal objects and advantages of the present invention include: providing a screed control device for a paver wherein the screed control is easily and quickly field interchangeable from a left-handed operation to a right-handed operation and visa versa; and generally providing such a screed control device which is simple and easy to use and maintain, easy to operate efficiently and reliably, which can be manufactured and installed inexpensively and which generally performs the requirements of its intended purposes.

Various objects, features and advantages of this invention will become apparent from the following description taken in conjunction with the accompanying drawings, which constitute a part of this specification and which set forth, by way of illustration, certain exemplary embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
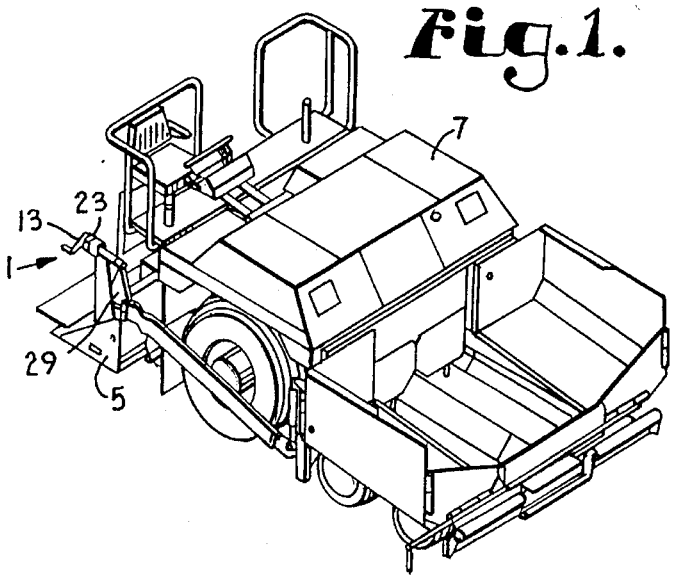
FIG. 1 is a perspective view of a paver having a screed with a reversible handedness control device, according to the present invention.
Figure 2:
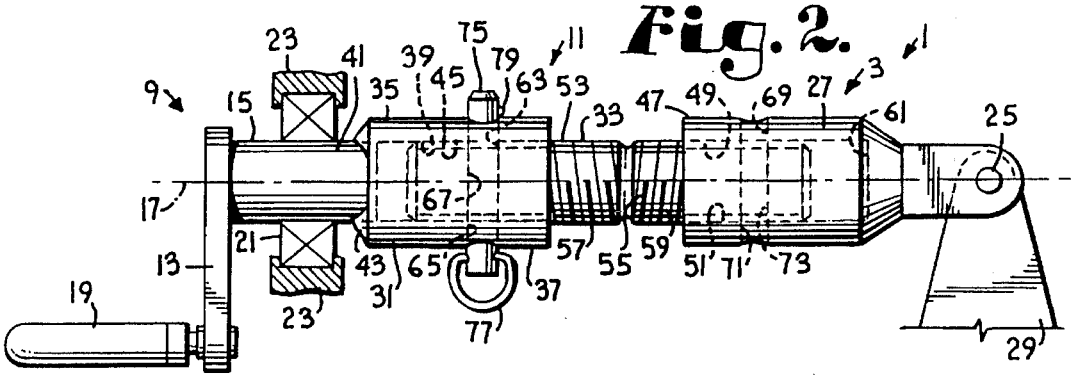
FIG. 2 is an enlarged side elevational view of the reversible handedness screed control device, showing an embodiment thereof.

A screed control device 1, as shown in FIGS. 1 and 2, comprises elevating means 3 for changing the "angle of attack" or elevation of a component of heavy equipment such as a screed 5 of a paver 7, cranking means 9 for manually and rotationally applying force to operate the elevating means 3, and reversing means 11 for reversing the handedness of the cranking means 9. Representative examples of the screed 5 and the paver 7 are described in greater detail in U.S. Pat. No. 5,356,238 to Musil et al., issued Oct. 18, 1994, which is incorporated herein by reference.

The cranking means 9 generally comprises a hand-crank 13 mounted on a shaft 15 adapted to rotate about an axis, designated by the numeral 17 in FIG. 2, such that a handle 19 can be revolved either clockwise or counterclockwise about the axis 17. The axis 17 is determined by the shaft 15 being rotatably mounted in a bearing 21 of a frame 23 of the paver 7 and a pivot pin 25 pivotally connecting a linkage 27 to a lever arm 29 of the screed 5.

The elevating means 3 generally includes a sleeve 31, an elevator 33 and the linkage 27. The sleeve 31 is preferably cylindrically shaped, with a shaft end 35 thereof fixedly connected to the shaft 15, as shown in FIG. 2. The opposite, elevator end 37 of the sleeve 31 has an axial bore 39 having an axis colinear with the axis 17. It is to be understood that, if desired, the bore 39 may be formed as a throughbore and converted to a partial bore by inserting a distal end 41 of the shaft 15 into the bore 39 and connecting them together, such as by a weld bead 43.

The bore 39 is tapped with right-hand threads 45. It is to be understood that the threads 45 can be either left-handed or right-handed within the spirit and scope of the present invention. The particular handedness cited herein is selected for clarity and discussion purposes only. The same handedness considerations apply to the following discussions unless expressly indicated otherwise. Similarly, the linkage 27 has an elevator end 47 with an axial bore 49 having an axis substantially colinear with the axis 17. The bore 49 is tapped with threads 51 having handedness opposite to that of the threads 45.

The elevator 33, which is cylindrically shaped, has a sleeve end 53 and a linkage end 55, each of the ends 53 and 55 constituting approximately one-half the length of the elevator 33. The peripheral surface of the sleeve end 53 is threaded with threads 57 having the same handedness as the threads 45 such that the elevator 33 can be threadably advanced into the bore 39 by turning the sleeve 31 clockwise, as viewed along the axis 17 toward the pivot pin 25 as shown in FIG. 2, relative to the elevator 33 and threadably withdrawn from the bore 39 by similarly turning the sleeve 31 counterclockwise. The mating threads 45 and 57 each have sufficient length whereby the screed 5 can be raised or lowered as necessary without bottoming the elevator 33 against the shaft 15 and without totally withdrawing the elevator 33 from the bore 39 as the elevator 33 is retained stationary relative to the linkage 27 as herein described.

The peripheral surface of the linkage end 55 is threaded with threads 59 having the same handedness as the threads 51 such that the elevator 33 can be threadably advanced into the bore 49 by turning the elevator 33 counterclockwise, as viewed along the axis 17 toward the pivot pin 25 as shown in FIG. 2, relative to the linkage 27 and threadably withdrawn from the bore 49 by similarly turning the elevator 33 clockwise. The mating threads 51 and 59 each have sufficient length whereby the screed 5 can be raised or lowered as necessary without bottoming the elevator 33 against an inner end 61 of the bore 49 and without totally withdrawing the elevator 33 from the bore 49 as the elevator 33 is retained stationary relative to the sleeve 31 as herein described.

The reversing means 11 generally comprises a pair of co-linearly aligned apertures 63 and 65 in the sleeve 31, an aperture 67 in the sleeve end 53 of the elevator 33 which is co-linearly alignable with the apertures 63 and 65, a pair of co-linearly aligned apertures 69 and 71 in the linkage 27, an aperture 73 in the linkage end 55 of the elevator 33 which is co-linearly alignable with the apertures 69 and 71, and a reversing pin 75, which is adapted to selectively configure the device 1 in either a right-handed configuration or a left-handed configuration.

For one of such right-handed or left-handed configurations, the reversing pin 75 is adapted to be received through the sleeve 31 and the sleeve end 53 of the elevator 33 as the apertures 63, 65 and 67 are co-linearly aligned. For the other of such right-handed or left-handed configurations, the reversing pin 75 is adapted to be received through the linkage 27 and the linkage end 55 of the elevator 33 as the apertures 69, 71 and 73 are co-linearly aligned.

The spacing between the apertures 67 and 73, the length of the threads 57 to each side of the aperture 67, the length of the threads 45 to each side of the apertures 63 and 65, the length of the threads 59 to each side of the aperture 73, and the length of the threads 51 to each side of the apertures 69 and 71 are sufficiently extensive whereby the screed 5 may be raised or lowered as desired without jeopardizing the integrity of the threadably interacting surfaces between the sleeve 31 and the elevator 33 and between the linkage 27 and the elevator 33 if the apertures 63, 65 and 67 are substantially co-linearly aligned and the apertures 69, 71 and 73 are substantially co-linearly aligned as the reversing pin 75 is transferred from one set of the apertures 63, 65 and 67, or 69, 71 and 73, to the other.

Either the apertures 63 and 65 or the aperture 67, or all of them, may be slots instead of throughbores to allow insertion of the reversing pin 75 therethrough without precise colinear alignment thereof. In that case, such slots preferably have major axes thereof oriented parallel to the axis 17 to minimize the amount of motion of the elevator 33 relative to the sleeve 31 as the reversing pin 75 is inserted therethrough. The same slot versus throughbore considerations apply to the apertures 69, 71 and 73.

The reversing pin 75 has a pull ring 77 and a spring-loaded keeper 79, or other suitable arrangement, to unattendably retain the reversing pin 75 in the selected set of throughbores 63, 65 and 67, or 69, 71 and 73.

In an application of the present invention, the reversing pin 75 is inserted through either the apertures 63, 65 and 67, or the apertures 69, 71 and 73. For purposes of discussion, assume that the reversing pin 75 is inserted through the apertures 63, 65 and 67 which provides the handedness preferred by a right-handed operator. Further assume that turning the hand-crank 13 such that the elevator 33 is threadably withdrawn outwardly from either of the bores 39 or 49 causes the screed 5 to be raised and that turning the hand-crank 13 such that the elevator 33 is threadably advanced into either of the bores 39 or 49 causes the screed 5 to be lowered.

Thus, as the hand-crank 13 is turned clockwise, as viewed along the axis 17 from the hand-crank 13 toward the pivot pin 25, the linkage end 55 of the elevator 33 is threadably withdrawn away from the linkage 27, raising the screed 5. Similarly, as the hand-crank 13 is turned counterclockwise, the linkage end 55 is threadably advanced into the linkage 27, lowering the screed 5.

Then assume that a left-handed operator, who prefers raising the screed 5 by turning the hand-crank 13 counterclockwise and lowering the screed 5 by turning the hand-crank 13 clockwise, uses the paver 7. To accommodate the left-handed operator, the hand-crank 13 is turned to align the apertures 69 and 71 with the aperture 73 such that the reversing pin 75 is slidably insertable therethrough. Then, the reversing pin 75 is pulled from the sleeve 31 and the sleeve end 53 of the elevator 33 and re-inserted through the apertures 69, 71 and 73 of the linkage 27 and the linkage end 55 of the elevator 33. Now, as the left-handed operator turns the hand-crank 13 counterclockwise, the sleeve end 53 of the elevator 33 is, indeed, threadably withdrawn away from the sleeve 31 thereby raising the screed 5, and as the left-handed operator turns the hand-crank 13 clockwise, the sleeve end 53 of the elevator 33 is threadably advanced into the sleeve 31 thereby lowering the screed 5.

Figure 3:
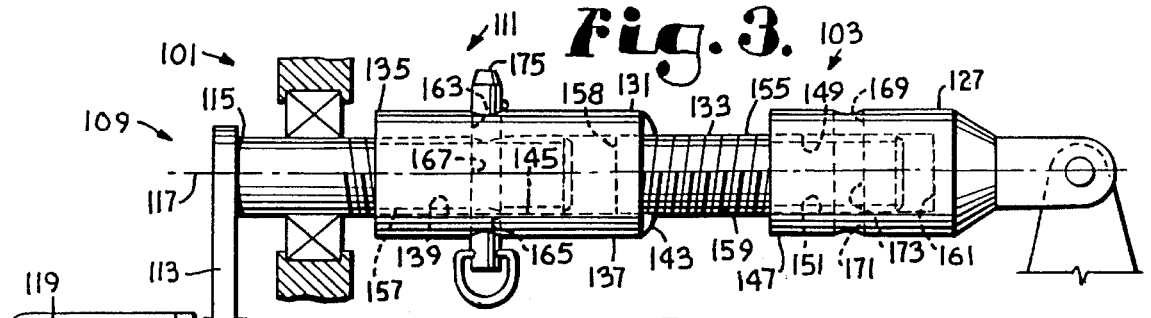
FIG. 3 is an enlarged side elevational view of the reversible handedness screed control device, showing a first modified embodiment thereof, according to the present invention.

A first modified or alternative embodiment of a reversible handedness screed control device 101 in accordance with the present invention is shown in FIG. 3. It is to be understood that many of the features and functions of the device 101 are substantially similar to those previously described herein for the embodiment 1 and, therefore, will not be reiterated here in detail.

The device 101 includes elevating means 103 for changing an "angle of attack" or elevation of a screed 5 of a paver 7, cranking means 109 for manually and rotationally applying force to operate the elevating means 103, and reversing means 111 for reversing the handedness of the cranking means 109.

The cranking means 109 generally comprises a hand-crank 113 mounted on a shaft 115 adapted to rotate about an axis, designated by the numeral 117 in FIG. 3, such that a handle 119 can be revolved either clockwise or counterclockwise about the axis 117.

The elevating means 103 generally includes a sleeve 131, an elevator 133 and a linkage 127. The sleeve 131 is preferably cylindrically shaped and has an elevator end 137 fixedly connected, such as by a weld bead 143, to the elevator 133, as shown in FIG. 3. The opposite, shaft end 135 of the sleeve 131 has an axial bore 139 with an axis colinear with the axis 117.

The bore 139 is tapped with right-hand threads 145. Again, it is to be understood that the threads 45 can be either left-handed or right-handed within the spirit and scope of the present invention as hereinbefore asserted. And, again, the particular handedness cited herein is selected for clarity and discussion purposes only. Similarly, the linkage 127 has an elevator end 147 with an axial bore 149 having an axis colinear with the axis 117. The bore 149 is tapped with threads 151 with handedness opposite to that of the threads 145. The elevator 133 has a linkage end 155.

The peripheral surface of the distal end of the shaft 115 is threaded with threads 157 having the same handedness as the threads 145 such that the shaft 115 can be threadably advanced into the bore 139 by turning the shaft 115 clockwise, as viewed endwise from the hand-crank 113 along the axis 117 as shown in FIG. 3, relative to the sleeve 131 and threadably withdrawn from the bore 139 by similarly turning the shaft 115 counterclockwise. The mating threads 145 and 157 each have sufficient length whereby the screed 5 can be raised or lowered as necessary without bottoming the shaft 115 against an end 158 and without totally withdrawing the shaft 115 from the bore 139 as the elevator 133 is retained stationary relative to the linkage 127.

The peripheral surface of the linkage end 155 of the elevator 133 is threaded with threads 159 having the same handedness as the threads 151 such that the elevator 133 can be threadably advanced into the bore 149 by turning the elevator 133 counterclockwise, as viewed from the hand-crank 113 along the axis 117, relative to the linkage 127 and threadably withdrawn from the bore 149 by similarly turning the elevator 133 clockwise. The mating threads 151 and 159 each have sufficient length whereby the screed 5 can be raised or lowered as necessary without bottoming the elevator 133 against an inner end 161 of the bore 149 and without totally withdrawing the elevator 133 from the bore 149 as the shaft 115 is retained stationary relative to the sleeve 131.

The reversing means 111 generally comprises a pair of co-linearly aligned apertures 163 and 165 in the sleeve 131, an aperture 167 in the shaft 115 which is co-linearly alignable with the apertures 163 and 165, a pair of co-linearly aligned apertures 169 and 171 in the linkage 127, an aperture 173 in the linkage end 155 of the elevator 133 which is co-linearly alignable with the apertures 169 and 171, and a reversing pin 175, which is adapted to selectively configure the device 101 in either a right-handed configuration or a left-handed configuration.

For one of such right-handed or left-handed configurations, the reversing pin 175 is adapted to be slidably received through the sleeve 131 and the shaft 115 as the apertures 163,165 and 167 are co-linearly aligned. For the other of such right-handed or left-handed configurations, the reversing pin 175 is adapted to be slidably received through the linkage 127 and the linkage end 155 of the elevator 133 as the apertures 169, 171 and 173 are co-linearly aligned.

The spacing between the apertures 167 and 173, the length of the threads 157 to each side of the aperture 167, the length of the threads 145 to each side of the apertures 163 and 165, the length of the threads 159 to each side of the aperture 173, and the length of the threads 151 to each side of the apertures 169 and 171 are sufficiently extensive that the screed 5 may be raised or lowered as desired without jeopardizing the integrity of the threadably interacting surfaces between the sleeve 131 and the shaft 115 and between the linkage 127 and the elevator 133 if the apertures 163, 165 and 167 are substantially co-linearly aligned and the apertures 169, 171 and 173 are substantially co-linearly aligned as the reversing pin 175 is transferred from one set of the apertures 163, 165 and 167, or 169, 171 and 173, to the other.

Either the apertures 163 and 165 or the aperture 167, or all of them, may be slots instead of throughbores to allow insertion of the reversing pin 175 therethrough without precise colinear alignment thereof. In that case, such slots should preferably have major axes thereof aligned parallel to the axis 117 as herein described. The same slot versus throughbore considerations apply to the apertures 169, 171 and 173.

Figure 5:
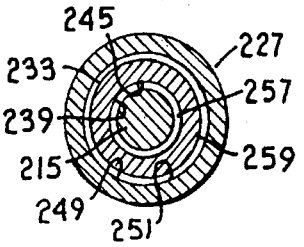
FIG. 5 is an enlarged cross-sectional view of the reversible handedness control screed control device, taken along line 5—5 of FIG. 4.
Figure 4:
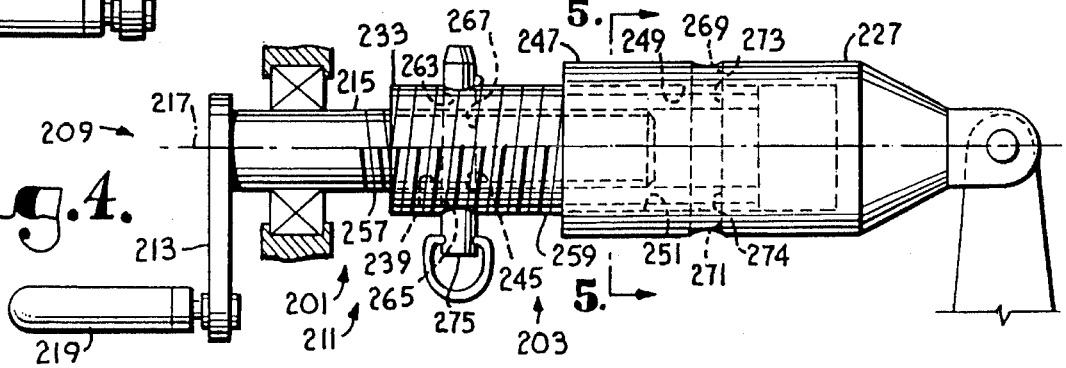
FIG. 4 is an enlarged side elevational view of the reversible handedness control screed control device, showing a second modified embodiment thereof, according to the present invention.

A second modified or alternative embodiment of a reversible handedness screed control device 201 in accordance with the present invention is shown in FIGS. 4 and 5. It is to be understood that many of the features and functions of the device 201 are substantially similar to those previously described for the embodiments 1 and 101 and, therefore, will not be reiterated here in detail.

The device 201 includes elevating means 203 for changing an "angle of attack" or elevation of a screed 5 of a paver 7, cranking means 209 for manually and rotationally applying force to operate the elevating means 203, and reversing means 211 for reversing the handedness of the cranking means 209.

The cranking means 209 generally comprises a hand-crank 213 mounted on a shaft 215 adapted to rotate about an axis, designated by the numeral 217 in FIG. 4, such that a handle 219 can be revolved either clockwise or counterclockwise about the axis 217.

The elevating means 203 generally includes an elevator or sleeve 233 and a linkage 227. The elevator sleeve 233 has an axial throughbore 239, the axis thereof being substantially colinear with the axis 217. The bore 239 is tapped with right-hand threads 245. Again, it is to be understood that the threads 245 can be either left-handed or right-handed within the spirit and scope of the present invention as hereinbefore asserted. And, again, the particular handedness cited herein is selected for clarity and discussion purposes only.

The linkage 227 has an elevator end 247 with an axial bore 249 having an axis substantially colinear with the axis 217. The bore 249 is tapped with threads 251 having handedness opposite to that of the threads 245.

The peripheral surface of the distal end of the shaft 215 is threaded with threads 257 having the same handedness as that of the threads 245 such that the shaft 215 can be threadably advanced into the bore 239 by turning the shaft 215 clockwise, as viewed endwise from the hand-crank 213 along the axis 217 as shown in FIG. 4, relative to the elevator sleeve 233 and threadably withdrawn from the bore 239 by similarly turning the shaft 215 counterclockwise. The mating threads 245 and 257 each have sufficient length whereby the screed 5 can be raised or lowered as necessary as hereinbefore described.

The outer peripheral surface of the elevator sleeve 233 is threaded with threads 259 having the same handedness as the threads 251 such that the elevator sleeve 233 can be threadably advanced into the bore 249 by turning the elevator sleeve 233 counterclockwise, as viewed from the hand-crank 213 along the axis 217, relative to the linkage 227 and threadably withdrawn from the bore 249 by similarly turning the elevator sleeve 233 clockwise. The mating threads 251 and 259 each have sufficient length whereby the screed 5 can be raised or lowered as necessary as hereinbefore described.

The reversing means 211 generally comprises a first pair of co-linearly aligned apertures 263 and 265 in the elevator sleeve 233, an aperture 267 in the shaft 215 which is co-linearly alignable with the apertures 263 and 265, a pair of co-linearly aligned apertures 269 and 271 in the linkage 227, a second pair of co-linearly aligned apertures 273 and 274 in the elevator sleeve 233 which are co-linearly alignable with the apertures 269 and 271, and a reversing pin 275, which is adapted to selectively configure the device 201 in either a right-handed configuration or a left-handed configuration.

For one of such right-handed or left-handed configurations, the reversing pin 275 is adapted to be received through the elevator sleeve 233 and the shaft 215 as the apertures 263, 265 and 267 are co-linearly aligned. For the other of such right-handed or left-handed configurations, the reversing pin 275 is adapted to be received through the linkage 227 and the elevator sleeve 233 as the apertures 269, 271, 273 and 274 are co-linearly aligned.

The spacing between the pair of apertures 263 and 265 and the pair of apertures 273 and 274, the length of the threads 257 to each side of the aperture 267, the length of the threads 245 to each side of the apertures 263 and 265, the length of the threads 259 to each side of the apertures 273 and 274, and the length of the threads 251 to each side of the apertures 269 and 271 are sufficiently extensive that the screed 5 may be raised or lowered as desired without jeopardizing the integrity of the threadably interacting surfaces between the shaft 215 and the elevator sleeve 233 and between the elevator sleeve 233 and the linkage 227 if the apertures 263, 265 and 267 are substantially co-linearly aligned and the pair of apertures 269 and 271 are substantially co-linearly aligned with the pair of apertures 273 and 274 as the reversing pin 275 is transferred from one set of the apertures 263, 265 and 267, or 269, 271, 273 and 274, to the other.

Either the apertures 263 and 265 or the aperture 267, or all of them, may be slots instead of throughbores to allow insertion of the reversing pin 275 therethrough without precise colinear alignment thereof. In that case, such slots should preferably have major axes thereof aligned parallel to the axis 217 as hereinbefore described. The same slot versus throughbore considerations apply to the apertures 269, 271, 273 and 274.

It is to be understood that the reversible handedness control device is readily adaptable to many different applications besides screeds, pavers, and other asphalt equipment and yet remain within the scope and spirit of the present invention.

It is to be understood that while certain forms of the present invention have been illustrated and described herein, it is not to be limited to the specific forms or arrangement of parts described and shown.

What is claimed and desired to be secured by Letters Patent is as follows:

1. A control device for a paver screed, comprising:

(a) elevating means for adjusting the angle of attack of the screed; said elevating means including two pairs of interacting cylindrical surfaces, a first pair of said two pairs of interacting surfaces threadably connected by "left-hand" threads and the second pair of said two pairs of interacting surfaces threadably connected by "right-hand" threads;

(b) cranking means for manually and rotationally operating said elevating means; and (c) reversing means for selectively changing said cranking means to and from a right-handed rotational configuration or a left-handed rotational configuration; said reversing means including a mechanism adapted to selectively maintain one pair of said two pairs of interacting surfaces stationary relative to each other as the other pair of said two pairs of interacting surfaces are allowed to threadably move relative to each other.

2. The device according to claim 1, including:

(a) a hand-crank having a shaft rotationally mounted to the paver about an axis;

(b) a sleeve connected to said shaft; said sleeve having a tapped first bore aligned co-linearly with said axis; said sleeve having a pair of co-linearly aligned, transversely opposing sleeve apertures;

(c) an elevator having a first end and a second end wherein said first end has first threads adapted to threadably interact with said tapped first bore and said second end has second threads having handedness opposite to that of said first threads; said first end having a transversely oriented first elevator aperture adapted to be co-linearly alignable with said pair of sleeve apertures; said second end having a transversely oriented second elevator aperture;

(d) a linkage pivotally connected to the screed; said linkage having a tapped second bore adapted to threadably interact with said second threads of said second end of said elevator as said second bore is co-linearly aligned with said axis; said linkage having a pair of co-linearly aligned, transversely opposing linkage apertures adapted to be co-linearly alignable with said second elevator aperture; and (e) a pin adapted to be slidably receivable through said pair of sleeve apertures and said first elevator aperture as said pair of sleeve apertures and said first elevator aperture are substantially co-linearly aligned and, further, to be slidably receivable through said pair of linkage apertures and said second elevator aperture as said pair of linkage apertures and said second elevator aperture are substantially co-linearly aligned.

3. The device according to claim 2, wherein at least one of said pair of sleeve apertures or said first elevator aperture and at least one of said pair of linkage apertures or said second elevator aperture are configured as slots, each having a major axis thereof aligned parallel to said axis.

4. The device according to claim 1, including:

(a) a hand-crank having a shaft rotationally mounted to the paver about an axis; said shaft having first threads; said shaft having a transversely oriented shaft aperture;

(b) a sleeve having a tapped first bore adapted to threadably interact with said first threads as said first bore is co-linearly aligned with said axis; said sleeve having a pair of co-linearly aligned, transversely opposing sleeve apertures adapted to be co-linearly alignable with said shaft aperture;

(c) an elevator having a first end and a second end wherein said first end is fixedly connected to said sleeve and said second end has second threads having handedness opposite to that of said first threads; said second end having a transversely oriented elevator aperture;

(d) a linkage pivotally connected to the screed; said linkage having a tapped second bore adapted to threadably interact with said second threads of said second end of said elevator as said second bore is co-linearly aligned with said axis; said linkage having a pair of co-linearly aligned, transversely opposing linkage apertures adapted to be co-linearly alignable with said elevator aperture; and (e) a pin adapted to be slidably receivable through said pair of sleeve apertures and said shaft aperture as said pair of sleeve apertures and said shaft aperture are substantially co-linearly aligned and, further, to be slidably receivable through said pair of linkage apertures and said elevator aperture as said pair of linkage apertures and said elevator aperture are substantially co-linearly aligned.

5. The device according to claim 4, wherein at least one of said pair of sleeve apertures or said shaft aperture and at least one of said pair of linkage apertures or said elevator aperture are configured as slots, each having a major axis thereof aligned parallel to said axis.

6. The device according to claim 1, including:

(a) a hand-crank having a shaft rotationally mounted to the paver about an axis; said shaft having first threads; said shaft having a transversely oriented shaft aperture;

(b) an elevator sleeve having a tapped first bore adapted to threadably interact with said first threads as said first bore is co-linearly aligned with said axis; said elevator sleeve having an outer peripheral surface with second threads having handedness opposite to that of said first threads; said elevator sleeve having a first pair of co-linearly aligned, transversely opposing elevator sleeve apertures adapted to be co-linearly alignable with said shaft aperture; said elevator sleeve also having a second pair of co-linearly aligned, transversely opposing elevator sleeve apertures;

(c) a linkage pivotally connected to the screed; said linkage having a tapped second bore adapted to threadably interact with said second threads of said elevator sleeve as said second bore is co-linearly aligned with said axis; said linkage having a pair of co-linearly aligned, transversely opposing linkage apertures adapted to be co-linearly alignable with said second pair of elevator sleeve apertures; and (d) a pin adapted to be slidably receivable through said first pair of elevator sleeve apertures and said shaft aperture as said first pair of elevator sleeve apertures and said shaft aperture are substantially co-linearly aligned and, further, to be slidably receivable through said pair of linkage apertures and said second pair of elevator sleeve apertures as said pair of linkage apertures and said second pair of elevator sleeve apertures are substantially co-linearly aligned.

7. The device according to claim 6, wherein at least one of said first pair of elevator sleeve apertures or said shaft aperture and at least one of said pair of linkage apertures or said second pair of elevator sleeve apertures are configured as slots, each having a major axis thereof aligned parallel to said axis.

* * * * *